US006548016B1

(12) United States Patent
Borgard

(10) Patent No.: US 6,548,016 B1
(45) Date of Patent: Apr. 15, 2003

(54) OIL SOLUBLE HYDROGEN PERMEATION INHIBITOR

(75) Inventor: Bradley G. Borgard, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 08/643,052

(22) Filed: May 2, 1996

(51) Int. Cl.[7] ..... C23F 11/04

(52) U.S. Cl. ..... 422/12; 422/7; 422/13; 422/16; 252/391; 252/392; 252/402; 252/403

(58) Field of Search ..... 422/12, 13, 16, 422/7; 252/391, 392, 402, 403

(56) References Cited

U.S. PATENT DOCUMENTS 3,445,441 A * 5/1969 Rushton
4,332,967 A * 6/1982 Thompson et al. ..... 422/12
4,393,026 A * 7/1983 Thompson et al. ..... 422/12
4,450,137 A * 5/1984 Thompson et al. ..... 422/12
5,169,598 A * 12/1992 Zetlmeisl et al. ..... 422/16

* cited by examiner

*Primary Examiner*—Jerry D. Johnson
*Assistant Examiner*—Basia Ridley
(74) *Attorney, Agent, or Firm*—Paula D. Morris & Associates, P.C.

(57) ABSTRACT

The present invention provides a composition and method for inhibiting hydrogen permeation in metal refinery equipment comprising incorporating into a product stream handled by said equipment a polyamine amide of 3-hydrocarbyl thiopropionic acid in an amount sufficient to inhibit said hydrogen permeation. In a preferred embodiment, the polyamine amide of 3-hydrocarbyl thiopropionic acid is selected from the group consisting of propanamide, N-[2-[2-[3-(dodecenyl)-2,5-dioxo-1-pyrrolidinyl]ethyl]amino]ethyl]-3-[dodecylthio]-2-methyl and 15-thia-5,8,11-triazaheptacosanoic acid, 2-(dodecenyl)-13-methyl-4,12-dioxo, and combinations thereof.

42 Claims, No Drawings

OIL SOLUBLE HYDROGEN PERMEATION INHIBITOR

FIELD OF THE INVENTION

The present invention relates to compositions and methods for decreasing hydrogen permeation into metal equipment used in wet refinery environments containing hydrogen sulfide, ammonia, and cyanide.

BACKGROUND OF THE INVENTION

An area of concern in refinery operations is hydrogen permeation into the equipment of water handling systems used to remove water soluble contaminants in several parts of the refining process. Crude oil containing nitrogen and sulfur compounds gives rise to a variety of water soluble compounds when the crude is catalytically or thermally cracked and fractionated. These compounds include ammonia, hydrogen sulfide, hydrogen cyanide (HCN) and numerous organic species having ionizing cyanide, sulfide ($S^{2-}$), or ammonium ($NH_4^+$) substituents.

Ammonia is known to react with hydrogen sulfide to give ammonium sulfide, which reacts further with hydrogen sulfide to give ammonium bisulfide. The bisulfide ion reacts with iron at the surface of the handling equipment to form ferrous sulfide. At the same time, atomic hydrogen is liberated. The cyanide ion is believed to destabilize the iron sulfide and to retard the recombination of atomic hydrogen into gaseous hydrogen. As a result, the surface concentration of atomic hydrogen increases. Atomic hydrogen is small enough to pass through the crystal lattice of the steel and, because of the concentration driving force, to pass through the steel and into the atmosphere. In the process, the steel becomes saturated with hydrogen and is considered to be hydrogen charged.

Steel in a hydrogen charged condition is subject to several cracking mechanisms, including sulfide stress cracking, hydrogen blistering, and stress-oriented hydrogen-induced cracking. The hydrogen permeating through the steel will run into a flaw, a dislocation, or a hole in the metal. Hydrogen atoms that recombine at this location form hydrogen gas, which tends to become stuck in the steel because the molecules are too large to move through the steel crystal lattice. As more and more hydrogen gas is trapped in the flaw, the pressure inside the metal starts to build. When the pressure at the flaw reaches the yield strength of the metal, the mechanical properties of the metal start to fail.

A number of materials have been used to inhibit hydrogen-induced cracking of metal. Unfortunately, none of these materials has been entirely successful.

SUMMARY OF THE INVENTION

The present invention provides a composition and method for decreasing corrosion and permeation of hydrogen into metal equipment used in wet refinery environments containing hydrogen sulfide, ammonia, and cyanide comprising incorporating into a product stream handled by said equipment a composition comprising a polyamine amide of 3-hydrocarbyl thiopropionic acid in an amount sufficient to inhibit said hydrogen permeation.

DETAILED DESCRIPTION OF THE INVENTION

The inhibitor of the present invention is a polyamine amide of 3-hydrocarbyl thiopropionic acid having the following general formula:

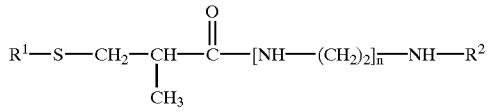

wherein n is between about 1–6;

wherein $R^1$ is a hydrocarbyl group comprising at least about 10 carbon atoms selected from the group consisting of straight, branched, and cyclic alkyl groups, alkenyl groups, and akynyl groups, aryl groups, alkaryl groups, and aralkyl groups, and heterocyclic alkyl groups containing oxygen or nitrogen as a ring constituent; and, wherein $R^2$ is a nitrogen-containing group selected from the group consisting of a cyclic imide group and a hydrocarbyl amide group wherein a nitrogen in said nitrogen-containing group also comprises a nitrogen of said polyamide, and wherein said cyclic imide group further comprises between about 4–6 carbon atoms, and wherein said hydrocarbyl group has between about 1–20 carbon atoms selected from the group consisting of straight, branched, and cyclic alkyl groups, alkenyl groups, and alkynyl groups.

In a most preferred embodiment, $R^1$ comprises a hydrocarbyl group having between about 10–14 carbon atoms, most preferably about 12 carbon atoms, and $R^2$ is a nitrogen-containing group selected from the group consisting of a cyclic imide group and a hydrocarbyl amide group wherein a nitrogen in said nitrogen-containing group also comprises a nitrogen of said polyamide, wherein said cyclic imide group further comprises between about 4–6 carbon atoms, and wherein said hydrocarbyl amide group comprises at least one oxygen double bonded to said hydrocarbyl in addition to the double-bonded oxygen forming said amide group, said hydrocarbyl group having between about 10–14 carbon atoms selected from the group consisting of straight, branched, and cyclic alkyl groups, alkenyl groups, and alkynyl groups.

The manufacture of a most preferred embodiment results in a mixture of two predominant compounds: propanamide, N-[2-[2-[3-(dodecenyl)-2,5-dioxo-1-pyrrolidinyl]ethyl]amino]ethyl]-3-[dodecylthio]-2-methyl ("PDDPDM"), which has the following formula:

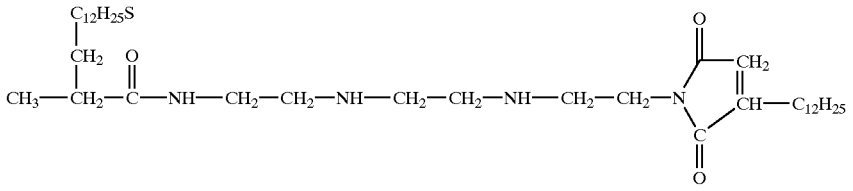

and, 15-thia-5,8,11-triazaheptacosanoic acid, 2-(dodecenyl)-13-methyl-4,12-dioxo ("TTDMD"), which has the following formula:

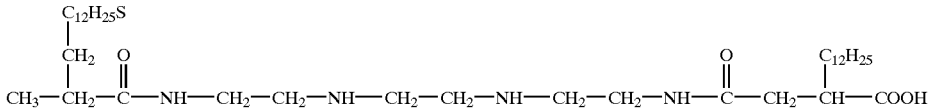

In other preferred permeation inhibitors, $R^1$ comprises a hydrocarbyl group comprising between about 10–14 carbon atoms, and $R^2$ is selected from the group consisting of a polyalkyleneamine, a nitrogen-containing group selected from the group consisting of a cyclic imide group, and a hydrocarbyl amide group, wherein a nitrogen in said nitrogen-containing group also comprises a nitrogen of said polyamine, and a hydrocarbyl group having between about 5–12 carbon atoms selected from the group consisting of straight, branched, and cyclic alkyl groups, alkenyl groups, and alkynyl groups, wherein said hydrocarbyl group comprises at least one substituent selected from the group consisting of a carboxyl group and an amine group.

Specific examples of such other preferred inhibitors include, but are not limited to the following, which are designated both by structure, and by their "CAS Index Name":

CAS Index Name

Propanamide, N-[2-[[2-[[2-[(2-aminoethyl)amino]ethyl]amino]ethyl]amino]ethyl]-3-(dodecylthio)-

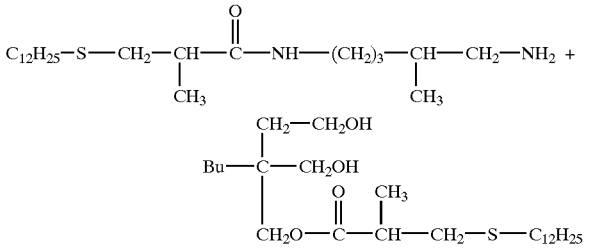

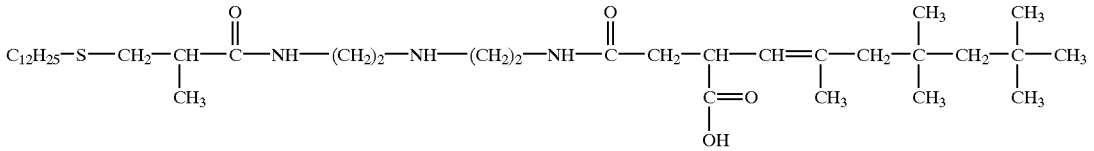

CAS Index Name

15-Thia-5,8,11-triazaheptacosanoic acid, 4,12-dioxo-2-(2,4,4,6,6-pentamethyl-1-heptenyl);

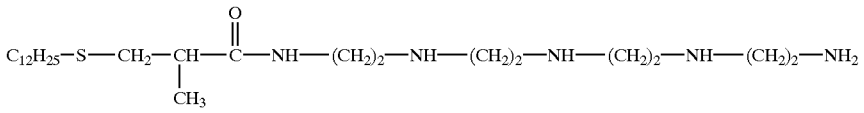

CAS Index Name

Propanamide, N-(5-amino-4-methylpentyl)-3-(dodecylthio)-2-methyl+Propanoic acid, 3-(dodecylthio)-2-methyl-2-(2-hydroxyethyl)-2-(hydroxymethyl)hexyl ester and

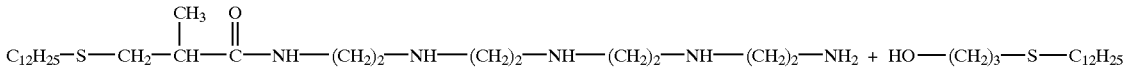

CAS Index Name

Propanamide, N-[2-[[2-[[2-[(2-aminoethyl)amino]ethyl]amino]ethyl]amino]ethyl]-3-(dodecylthio)-2-methyl-+1-Propanol, 3-(dodecylthipo)- and

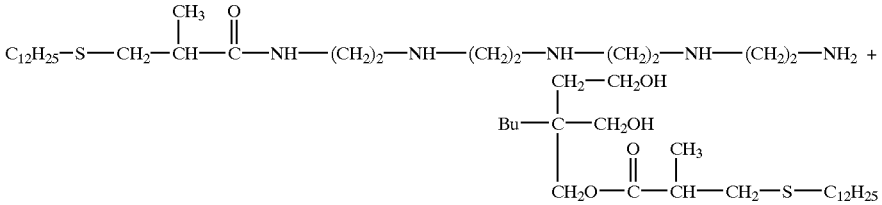

CAS Index Name

Propanamide, N-[2-[[2-[[2-[(2-aminoethyl)amino]ethyl]amino]ethyl]amino]ethyl]-3-(dodecylthio)-2-methyl-+Propanoic acid, 3-(dodecylthio)-2-methyl-2-(2-hydroxyethyl)-2-(hydroxymethyl)hexyl ester In order to measure the efficacy of a hydrogen permeation inhibitor, the hydrogen permeation of a given environment must be measured. The hydrogen charging capability of an environment is measured by the rate of proton discharge and the amount of hydrogen absorbed as a result. Electrochemical hydrogen permeation measurements allow the measurement of hydrogen flux through the material.

In the following experiments, the electrochemical test system was a Devanathan type cell in which a steel membrane or "coupon" acted as a bi-electrode. On one side of the membrane or "coupon" (the cathodic or charging side), a simulated fluid catalytic cracker ("FCC") solution was added in which hydrogen was deposited due to wet $H_2S$ corrosion or artificial charging of the coupon. On the other side of the coupon (the anodic or collecting side), the evolved hydrogen quantity was measured. A separate, electrically isolated solution existed on the collection side of the coupon. Separate electrical circuitry made the anodic or collecting side of the coupon, at which hydrogen was evolved, an anode. Here, the hydrogen that entered the coupon on the input side was anodically dissolved out. The anodic current was a measure of the hydrogen permeation through the coupon. Preferred inhibitors reduced the anodic current of a given control with a minimum corrosion rate of about 80–120 mils per year by at least about 50%, preferably by at least about 60–70%, most preferably by about 75%.

In order to inhibit hydrogen permeation, between about 6–24 ppm, preferably about 12 ppm of the inhibitor should be used based on the hydrocarbon in the system. The inhibitors may be used in high pressure areas, such as after compressors and/or before exchangers, in any type of refinery unit that experiences hydrogen permeation damage. The most common applications for the inhibitors of the present invention are fluid catalytic cracking (FCC) units and cokers which are not equipped with a system to permit water washing of high pressure areas. The inhibitors of the present invention normally will be added where a water wash would be found, if present.

The inhibitors of the present invention can be manufactured by charging a thiol bearing a desired $R^1$ to a reactor along with tetrabutylammonium hydroxide, preferably a 40 wt % by solution, as a catalyst. A desired methacrylate, such as methyl- or allyl-methacrylate, preferably methyl methacrylate, then should be charged to the reactor over a period of about 15 minutes. During this time, the reaction mixture may experience a temperature increase of about 53° C. (127° F.). The contents should be stirred while cooling for about 15 minutes. During this stirring period, the color of the pot contents may change, for example, from beige to pink to green. After verifying that the desired intermediate has been formed, e.g. using IR analysis, a desired polyalkylenepolyamine, such as diethylene triamine, should be added, and the contents of the reactor should be heated until distillate begins to appear in the overhead [136° C. (277° F.)]. The heating should be continued, and all of the overhead material should be collected over a period of about 1.5 hours. During this time, the temperature of the material may increase from about 136° C. (277° F.) to about 180° C. (356° F.). The distillate should be analyzed, e.g. by IR analysis, to verify that the polyalkylenepolyamine has formed the desired amide.

Thereafter, the reactor contents should be cooled to about 80° C. (176° F.), and a compound that will react with the free $NH_2$ group at the end of the polyalkylenepolyamine to form a desired $R^2$, e.g., dodecenyl succinic anhydride, should be charged to the reactor over a ½ hour period with no heating or cooling, resulting in an exotherm. The reactor contents should be heated to ref lux and a steady flow of distillate collected. When no more distillate is coming overhead, the reactor contents should be cooled while mildly blowing nitrogen into the system to prevent air oxidation of the contents at the high temperature.

When the temperature drops to about 70° C. (158° F.), nitrogen should be discontinued and a sample should be taken for IR analysis to confirm that the desired inhibitor has been formed. The temperature should be maintained above 60° C. (140° F.) and a desired amount of solvent, such as Fina Solv-150™, should be added and mixed for about 15 minutes. At this point, the product may be transferred to drums or other vessels for use or storage.

Without limiting the present invention, the mechanism of the foregoing reaction is believed to be as follows:

Step 1

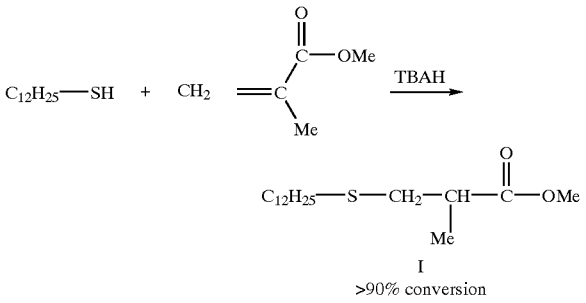

Step 2

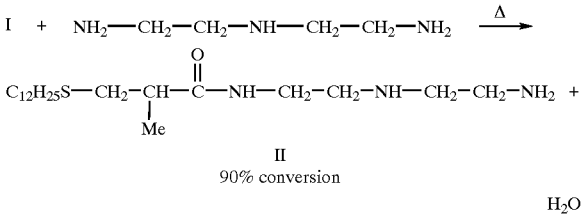

Step 3

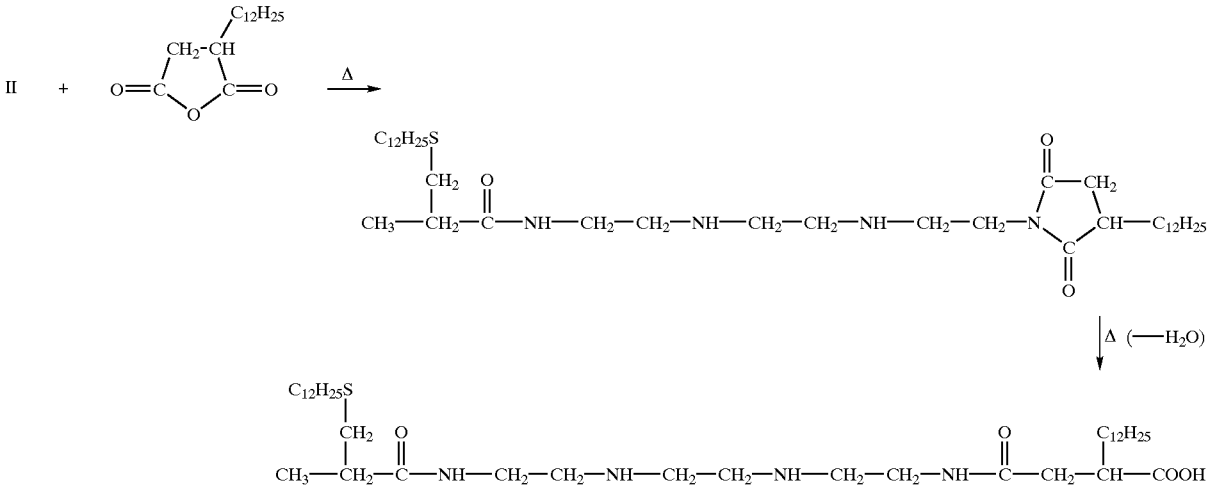

The invention will be better understood with reference to the following examples, which are illustrative only, and should not be construed as limiting the present invention.

EXAMPLE 1

A mixture of PDDPDM and TTDMD was prepared using the ingredients at the weights and the % reactor charge shown in Table I:

TABLE I

| INGREDIENT | POUNDS | % OF REACTOR CHARGE |
|---|---|---|
| n-Dodecane thiol | 382 | 15.43 |
| Methyl methacrylate | 189 | 7.63 |
| Diethylene-triamine (DETA) | 195 | 7.87 |
| Dodecenyl succinic anhydride (DDSA) | 505 | 20.40 |
| 40% Tetrabutyl-ammonium hydroxide (TBAH) | 24.8 | 1.00 |
| minus overhead material | (−115) | |
| Fina Solv-150 | 1,181 | 47.67% |
| TOTALS | 2362 | 100% |

* Since 115 pounds of the reactor charge before solvent was lost overhead, the final product is 50.0% active.

The n-dodecane thiol was charged to a reactor along with the 40% tetrabutylammonium hydroxide. A small amount of water phase formed, since water was the solvent for the catalyst, TBAH. The methyl methacrylate was charged over 15 minutes, resulting in a temperature rise of about 53° C. (127° F.) during the addition. The contents was stirred while cooling for 15 minutes. During this stirring period, the color of the pot contents changed from beige to pink and, finally, to green. a ½ oz sample was taken for IR analysis.

Thereafter, all of the DETA was added, with no resulting exotherm. The contents of the reactor was heated until distillate began to appear in the overhead [136° C. (277° F.)]. The heating was continued, and all of the overhead material was collected over a period of about 1.5 hours. During this time, the temperature increased from about 136° C. (277° F.) to about 180° C. (356° F.), and about 76.1 lb of distillate accumulated. A ½ oz sample of the reactor contents was taken for IR analysis.

The reactor contents was cooled to 80° C. (176° F.), and the DDSA was charged to the reactor over a ½ hour period with no heating or cooling, resulting in an exotherm. The reactor contents were heated to reflux and all of the overhead material was collected. Distillate began to condense at 135° C. (275° F.). Heating was continued in order to maintain a steady flow of distillate. From 135–190° C. (275–374° F.), 39.1 lb of distillate formed. When no more distillate was coming overhead, the reactor contents were cooled while mildly blowing nitrogen into the system to prevent air oxidation of the contents at the high temperature.

When the temperature dropped to 70° C. (158° F.), nitrogen was discontinued and a ½ oz sample was taken for IR analysis. The temperature was maintained above 60° C. (140° F.) and 1,179 lb of Fina Solv-150™ was added and mixed for 15 minutes. A final retainer sample was withdrawn, and the PDDPDM/TTDMD solution was transferred to drums.

EXAMPLE 2

The efficacy of the PDDPDM/TTDMD solution produced in Example 1 was compared to four commercially available corrosion and/or hydrogen permeation inhibitors. Specimens were machined from A516-70 reactor vessel steel. The coupons were machined by Metal Samples from steel plate to 0.030 inches in thickness with a bead blasted surface finish. The steel was allowed to corrode prior to the permeation measurement in order to allow the system to equilibrate to a steady state.

A steel coupon was positioned between two compartments of an electrochemical cell. The right side was designated as the charging cell, the left side as the collecting cell. A simulated FCCU fluid was prepared using the procedure described in the following paper: R. D. Merrick and M. L. Bullen. "Prevention of Cracking in Wet $H_2S$ Environments." Paper Number 269 presented at the Corrosion 1989 Convention, Apr. 17–21, 1989, incorporated herein by reference.

Basically, distilled water was deareated and ammonium sulfide was added to form about 250 ml of a 1% sulfide solution in ammonium sulfide. Potassium cyanide was added to form a 0.68 wt % solution of cyanide with a pH of 9.0 at 66° C. (150° F.). In order to determine how the inhibitor partitioned out of the hydrocarbon phase and into the water phase, kerosene was added to the cell in a 1:5 ratio to the water phase. 0.1 N NaOH was placed in the collection cell. An oxidizing potential of 250 mV vs. standard calomel electrode (SCE) was applied to the collecting side of the coupon using a potentiostat. At this potential, the diffusing hydrogen atoms reaching the collecting side of the coupon are oxidized to protons, and the resulting anodic permeation current is measured.

Using a frequency response analyzer and a potentiostat, electrochemical impedance scans and linear polarization corrosion rates were determined on the coupon on the morning before permeation scans were run. The steel was galvanostatically charged at three different charging currents—50 $\mu$A, 75 $\mu$A, and 150 $\mu$A—and hydrogen permeation was measured for the blank system at each charging current. The corrosion rate then was measured on the permeation coupon simultaneously with the background permeation current to determine the background flux. The corrosion rate was determined using electrochemical linear polarization.

After measuring hydrogen permeation at a given charging current, 250 ppm of the candidate inhibitor was added to the system, based on the water present in the sample, and the system was allowed to reequilibrate for about 24 hours. After 24 hours of reequilibration, the electrochemical impedance and linear polarization corrosion rates were again measured to determine the amount of inhibition achieved at the given charging current. The results were compared to the respective blank to determine the inhibitor's relative performance in reducing the corrosion and hydrogen permeation rate.

The results are given in Table II, in which 0 represents no reduction in corrosion and 100 is total corrosion reduction between the uninhibited and inhibited tests. If the inhibitor caused the corrosion rate to decrease, and the permeation efficiency was unaffected, the permeation of hydrogen was lower. A high efficiency means that the inhibitor either acted as a physical barrier to hydrogen absorption at the interface or that the inhibitor interfered with the mechanism of absorption (e.g., by increasing surface diffusion of hydrogen).

TABLE II

| Performance by Percent Reduction | | |
|---|---|---|
| INHIBITOR NAME | CORROSION RATE REDUCTION[6] | HYDROGEN PERMEATION REDUCTION[7] |
| Nalco 5162[1] | 45.3% | 13.0% |
| Air Products OW-1[2] | 29.0% | 30.0% |
| Cronox 276[3] | 73.3% | 47.0% |
| IPC 2030[4] | 73.8% | 31.8% |
| PDDPDM/TTDMD[5] | 73.7% | 64.7% |

[1]Nalco 5162 ™ is an oil soluble imidazoline inhibitor available from Nalco Chemical Company.
[2]Air Products OW-1 ™ is a permeation inhibitor available from Air Products Corp., Allentown, PA.
[3]Cronox 276 ™ is an inhibitor available from Baker Performance Chemicals, Houston, Texas.
[4]IPC 2030 is a corrosion inhibitor available from Chemlink, Houston, Texas.
[5]PDDPDM/TTDMD is the experimental material produced in Example 1.

The corrosive environment in this test was much more severe than those found in a typical production unit. The corrosion rates produced in the permeation cells usually ranged from 80 to 120 mils per year. An inhibitor was considered to be effective if it: (1) reduced the corrosion rate of the system to an acceptable level (about 70% reduction or more compared to the blank); (2) reduced the permeation efficiency to an acceptable level (about 50% reduction or more from the blank); (3) was cost effective; and (4) was able to penetrate into the affected area.

The experimental candidate, PDDPDM/TTDMD, was effective both to inhibit corrosion and to inhibit hydrogen permeation.

Persons of skill in the art will appreciate that many modifications may be made to the embodiments described herein without departing from the spirit of the present invention. Accordingly, the embodiments described herein are illustrative only and are not intended to limit the scope of the present invention.

I claim:

1. A method for inhibiting hydrogen permeation into metal equipment comprising:

providing a product stream handled by equipment comprising metal in a wet refinery environment, said product stream comprising hydrogen sulfide, ammonia, and cyanide; and incorporating into said product stream a composition comprising a polyalnine amide of 3-hydrocarbyl thiopropionic acid in an amount sufficient to inhibit said hydrogen permeation.

2. The method of claim 1 wherein said composition further comprises a substituent selected from the group consisting of a succinimide or a succinamide substituted monoamine, wherein a nitrogen of said substituent also comprises a nitrogen of said polyamine.

3. The method of claim 2 wherein said amount of said. composition comprises between about 6–24 ppm based on hydrocarbon in said product stream.

4. The method of claim 2 wherein said wet refinery environment is selected from the group consisting of fluid catalytic cracking units and cokers.

5. The method of claim 1 wherein said composition comprises 15-thia-5,8,11-triazaheptacosanoic acid, 4,12-dioxo-2-(2,4,4,6,6-pentamethyl-1-heptenyl).

6. The method of claim 5 wherein said wet refinery environment is selected from the group consisting of fluid catalytic cracking units and cokers.

7. The method of claim 1 wherein said composition is selected from the group consisting of propanamide, N-(5-amino-4-methylpentyl)-3-(dodecylthio)-2-methyl, and mixtures thereof with propanoic acid, 3-(dodecylthio)-2-methyl-, 2-(-2-hydroxyethyl)-2-(hydroxymethyl)hexyl ester.

8. The method of claim 1 wherein said composition comprises propanamide, N-[2-[[2-[[2-[(2-aminoethyl) aminolethyl]amino]ethyl]amino]ethyl]-3-(dodecylthio)-.

9. The method of claim 1 wherein said composition is selected from the group consisting of propanamide, N-[2-[[2-[[2-[(2-aminoethyl)amino]ethyl]amino]ethyl]amino] ethyl]-3-(dodecylthio)-2-methyl-, and mixtures thereof with 1-Propanol, 3-(dodecylthio)-.

10. The method of claim 1 wherein said composition is selected from the group consisting of propanamide, N-[2-[[2-[[2-[(2-amino]ethyl)amino]ethyl]amino]ethyl]amino] ethyl]-3-(dodecylthio)-2-methyl-, and mixtures thereof with propanoic acid, 3-(dodecylthio)-2-methyl-, 2-(2-hydroxyethyl)-2-(hydroxymethyl)hexyl ester.

11. The method of claim 1 wherein said amount of said composition comprises between about 6–24 ppm based on hydrocarbon in said product stream.

12. The method of claim 1 wherein said composition comprises 15-Thia-5,8,11-triazaheptacosanoic acid, 4,12-dioxo-2-(2,4,4,6,6-pentamethyl-1-heptenyl).

13. The method of claim 12 wherein said incorporating comprises introducing said composition at a location comprising a high pressure area in said wet refinery environment.

14. The method of claim 1 wherein said incorporating comprises introducing said composition at a location comprising a high pressure area in said wet refinery environment.

15. The method of claim 14 wherein said incorporating comprises introducing said composition at a location comprising a high pressure area in said wet refinery environment.

16. The method of claim 11 wherein said wet refinery environment is selected from the group consisting of fluid catalytic cracking units and cokers.

17. The method of claim 1 wherein said composition reduces the corrosion rate of said metal equipment by about 70% or more relative to the corrosion rate of said metal equipment under the same conditions in the absence of said composition.

18. The method of claim 1 wherein said composition reduces the permeation efficiency in said metal equipment by about 50% or more relative the permeation efficiency of said metal equipment under the same conditions in the absence of said composition.

19. A method for inhibiting hydrogen permeation into metal equipment comprising:

providing a product stream handled by equipment comprising metal in a wet refinery environment, said product stream comprising hydrogen sulfide, ammonia, and cyanide; and incorporating into said product stream an amount of a composition effective to inhibit said hydrogen permeation, wherein said composition is selected from the group consisting of: propanamide, N-[2-[2-[3-(dodecenyl)-2,5-dioxo-1-pyrrolidinyl]ethyl]amino] ethyl]-3-[dodecylthio]-2-methyl; 15-thia-5,8,11-triazaheptacosanoic acid, 2-(dodecenyl)-13-methyl-4, 12-dioxo; and, combinations thereof.

20. The method of claim 19 wherein said amount of said composition comprises between about 6–24 ppm based on hydrocarbon in said product stream.

21. The method of claim 19 wherein said amount of said composition comprises about 12 ppm based on hydrocarbon in hydrocarbon in said product stream.

22. The method of claim 19 wherein said incorporating comprises introducing said composition at a location comprising a high pressure area in said wet refinery environment.

23. The method of claim 19 wherein said wet refinery environment is selected from the group consisting of fluid catalytic cracking units and cokers.

24. The method of claim 19 wherein said composition reduces the corrosion rate of said metal equipment by about 70% or more relative to the corrosion rate of said metal equipment under the same conditions in the absence of said composition.

25. The method of claim 19 wherein said composition reduces the permeation efficiency in said metal equipment by about 50% or more relative the permeation efficiency of said metal equipment under the same conditions in the absence of said composition.

26. A method for inhibiting permeation of hydrogen into metal equipment comprising:

providing a product, stream handled by equipment comprising metal in a wet refinery environment, said product stream comprising hydrogen sulfide, ammonia, and cyanide; and incorporating into said product stream an amount of a composition effective to inhibit said hydrogen permeation, wherein said composition has the following general formula:

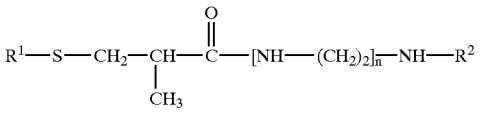

wherein n is between about 1–6;

wherein $R^1$ is a hydrocarbyl group comprising at least about 10 carbon atoms selected from the group consisting of straight, branched, and cyclic alkyl groups, alkenyl groups, and alkynyl groups, aryl groups, alkaryl groups, and aralkyl groups, and heterocyclic alkyl groups containing oxygen or nitrogen as a ring constituent; and, wherein $R^2$ is selected from the group consisting of hydrogen, nitrogen-containing groups selected from the group consisting of amine groups, amide groups, and cyclic imide groups, wherein a nitrogen of a nitrogen-containing group also comprises a nitrogen of said polyamine, and hydrocarbyl groups having at between about 1–20 carbon atoms selected from the group consisting of straight, branched, and cyclic alkyl groups, alkenyl groups, alkynyl groups, aryl groups, alkaryl groups, and aralkyl groups, and heterocyclic alkyl or alkenyl groups containing oxygen or nitrogen as a ring constituent.

27. The method of claim 26 wherein $R^1$ comprises a hydrocarbyl group having between about 10–14 carbon atoms; and, $R^2$ comprises a nitrogen-containing group selected from the group consisting of a cyclic imide group, a polyamine group, an amine group, and an amide group, wherein the nitrogen in said nitrogen-containing group comprises a nitrogen of said polyamine, wherein said cyclic imide group further comprises between about 4–6 carbon atoms, and wherein said hydrocarbyl amide group comprises at least one oxygen double bonded to said hydrocarbyl in addition to the double bonded oxygen forming said amide group, said hydrocarbyl group having between about 10–14 carbon atoms selected from the group consisting of straight, branched, and cyclic alkyl groups, alkenyl groups, and alkynyl groups.

28. The method of claim 27 wherein said incorporating comprises introducing said composition at a location comprising a high pressure area in said wet refinery environment.

29. The method of claim 27 wherein said wet refinery environment is selected from group consisting of fluid catalytic cracking units and cokers.

30. The method of claim 26 wherein $R^1$ comprises an alkyl group comprising between about 10–14 carbon atoms; and $R^2$ is selected from the group consisting of succinimide and succinamide substituted monoamine.

31. The method of claim 30 wherein said incorporating comprises introducing said composition at a location comprising a high pressure area in said wet refinery environment.

32. The method of claim 30 wherein said wet refinery environment is selected from group consisting of fluid catalytic cracking units and cokers.

33. The method of claim 26 wherein $R^1$ comprises an alkyl group comprising between about 10–14 carbon atoms; and $R^2$ is selected from the group consisting of a polyalkyleneamine, a nitrogen-containing group selected from the group consisting of a cyclic imide group, and a hydrocarbyl amide group, wherein a nitrogen in said nitrogen-containing group also comprises a nitrogen of said polyamine, and a hydrocarbyl group having between about 5–12 carbon atoms selected from the group consisting of straight, branched, and cyclic alkyl groups, alkenyl groups, and alkynyl groups, wherein said hydrocarbyl group comprises at least one substituent selected from the group consisting of a carboxyl group and an amine group.

34. The method of claim 33 wherein said incorporating comprises introducing said composition at a location comprising a high pressure area in said wet refinery environment.

35. The method of claim 33 wherein said wet refinery environment is selected from the group consisting of fluid catalytic cracking units and cokers.

36. The method of claim 26 wherein said amount of said composition comprises between about 6–24 ppm based on hydrocarbon in said product stream.

37. The method of claim 26 wherein said incorporating comprises introducing said composition at a location comprising a high pressure area in said wet refinery environment.

38. The method of claim 26 wherein said wet refinery environment is selected from the group consisting of fluid catalytic cracking units and cokers.

39. The method of claim 26 wherein said composition reduces the corrosion rate of said metal equipment by about 70% or more relative to the corrosion rate of said metal equipment under the same conditions in the absence of said composition.

40. The method of claim 26 wherein said composition reduces the permeation efficiency in said metal equipment by about 50% or more relative the permeation efficiency of said metal equipment under the same conditions in the absence of said composition.

41. A method for decreasing corrosion and permeation of hydrogen into metal equipment used in wet refinery environments containing hydrogen sulfide, ammonia, and cyanide comprising incorporating into a product stream handled by said equipment an amount of a composition that is effective to inhibit said hydrogen permeation, wherein said composition has the following general formula:

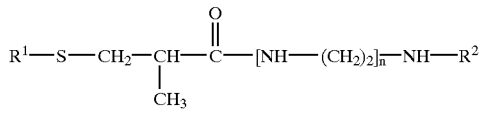

wherein n is between about 1–6;

wherein $R^1$ is a hydrocarbyl group comprising at least about 10 carbon atoms selected from the group consisting of straight, branched, and cyclic alkyl groups, alkenyl groups, and alkynyl groups, aryl groups, alkaryl groups, and aralkyl groups, and heterocyclic alkyl groups containing oxygen or nitrogen as a ring constituent; and, wherein $R^2$ is a nitrogen-containing group selected from the group consisting of a cyclic imide group and a hydrocarbyl amide group wherein a nitrogen in said nitrogen-containing group also comprises a nitrogen of said polyamide, and wherein said cyclic imide group further comprises between about 4–6 carbon atoms, and wherein said hydrocarbyl group has between about 1–20 carbon atoms selected from the group consisting of straight, branched, and cyclic alkyl groups, alkenyl groups, and alkynyl groups.

42. The method of claim 41 wherein said incorporating comprises introducing said composition at a location comprising a high pressure area in said wet refinery environment.

* * * * *

UNITED STATES PATENT AND TRADEMARK OFFICE

CERTIFICATE OF CORRECTION

PATENT NO. : 6,548,016 B1
DATED : April 15, 2003
INVENTOR(S) : Bradley G. Borgard It is certified that error appears in the above-identified patent and that said Letters Patent is hereby corrected as shown below:

Title page,
Item [*] Notice, should read:
-- Subject to any disclaimer, ther term of this patent is extended or adjusted under 35 U.S.C. 154(b) by 881 days. --.

Signed and Sealed this

Eighteenth Day of April, 2006

JON W. DUDAS
*Director of the United States Patent and Trademark Office*